US006318642B1

(12) United States Patent
Goenka et al.

(10) Patent No.: US 6,318,642 B1
(45) Date of Patent: Nov. 20, 2001

(54) NOZZLE ASSEMBLY

(75) Inventors: Lakhi Nandial Goenka, Ann Arbor; Malgorzata M. Skender, Birmingham, both of MI (US)

(73) Assignee: Visteon Global Tech., Inc, Dearborn, MI (US)

( * ) Notice: Subject to any disclaimer, the term of this patent is extended or adjusted under 35 U.S.C. 154(b) by 0 days.

(21) Appl. No.: 09/470,140

(22) Filed: Dec. 22, 1999

(51) Int. Cl.[7] ..... B05B 17/00; B05B 1/28

(52) U.S. Cl. ..... 239/8; 239/290; 239/291; 239/296; 239/298; 239/299

(58) Field of Search ..... 239/290, 291, 239/296, 298, 299, 8

(56) References Cited

U.S. PATENT DOCUMENTS

| | | | | |
|---|---|---|---|---|
| 271,641 | * | 2/1883 | Kelly | 239/290 |
| 645,416 | * | 3/1900 | Bush | 239/290 |
| 1,326,483 | * | 12/1919 | Doran | 239/291 |
| 2,138,300 | * | 11/1938 | Gustafsson | 239/290 X |
| 2,410,532 | * | 11/1946 | Tessier | 239/291 |
| 2,478,557 | * | 8/1949 | Bell et al. | 239/291 X |
| 2,597,573 | * | 5/1952 | Groff | 239/291 X |
| 4,179,068 | * | 12/1979 | Dombrowski | 239/290 X |
| 4,767,056 | * | 8/1988 | Demetrius et al. | 239/290 X |
| 5,284,554 | | 2/1994 | Datta et al. . | |
| 5,445,185 | | 8/1995 | Watanabe et al. . | |
| 5,486,676 | * | 1/1996 | Aleshin | 239/290 X |
| 5,545,073 | | 8/1996 | Kneisel et al. . | |
| 5,566,703 | | 10/1996 | Watanabe et al. . | |
| 5,679,062 | | 10/1997 | Goenka et al. . | |
| 5,815,181 | | 9/1998 | Kashino et al. . | |
| 5,836,150 | | 11/1998 | Garcia . | |
| 5,901,908 | | 5/1999 | Goenka et al. . | |
| 5,920,013 | | 7/1999 | Boardman et al. . | |

* cited by examiner

*Primary Examiner*—Robin O. Evans
(74) *Attorney, Agent, or Firm*—Visteon Global Technologies, Inc.

(57) ABSTRACT

A nozzle assembly 12 having shroud members 26, 28 which selectively emit a material 21 along at least one edge of emitted material 25. The selectively emitted material 21 substantially prevents and/or eliminates the turbulent shear layer which is formed within the emitted material 25.

13 Claims, 5 Drawing Sheets

NOZZLE ASSEMBLY

FIELD OF THE INVENTION

This invention relates to a nozzle assembly and more particularly, to a nozzle assembly which selectively emits material and which substantially prevents and/or which substantially reduces the amount of turbulence occurring within certain portions of the emitted material, thereby allowing the emitted material to be selectively deposited upon a surface and/or upon a targeted location in a desired manner.

BACKGROUND OF THE INVENTION

Nozzle assemblies selectively emit various types of materials, such as and without limitation paint, thereby allowing the selectively emitted material to be placed or deposited upon various objects and/or upon one or more "targeted locations" in some desired pattern and/or concentration.

It is oftentimes desirable to cause the deposited material to form or include substantially "well-defined", substantially straight, "crisp", and/or "clean" edges or borders in order to allow the deposited material to create an overall aesthetically pleasing appearance and/or to substantially ensure that only the targeted location(s) or object(s) actually receive the emitted material. For example, vehicle paint striping should normally have relatively well-defined and relatively straight edges in order to properly enhance the overall appearance of the vehicle.

While prior nozzle assemblies selectively emit material and allow the selectively emitted material to be placed upon various objects and/or targeted locations, they do not readily provide such well-defined or substantially straight edges due to the creation and/or existence of a relatively turbulent "shear layer" of material which typically occurs at and/or along the edges and/or at and/or along the extremities of the emitted material, and which is typically formed by the entrainment of ambient air into the edge and/or boundary/extremity portions of the emitted material.

There is therefore a need for a new and improved nozzle assembly which allows material to be selectively emitted and deposited upon a targeted location and/or object; which allows the selectively deposited material to form substantially well-defined, relatively straight, and/or "crisp" and/or "clean" edges and/or boundaries which allow the deposited material to provide an overall aesthetically pleasing appearance; and which reduces the likelihood that the selectively emitted material is inadvertently deposited upon non-targeted objects and/or locations.

SUMMARY OF THE INVENTION

It is a first object of the invention to provide a nozzle assembly which overcomes some or all of the previously delineated disadvantages of prior nozzle assemblies.

It is a second object of the invention to provide a nozzle assembly which overcomes some or all of the previously delineated disadvantages of prior nozzle assemblies, which selectively emits material, and which includes a shroud member or portion which substantially reduces and/or eliminates turbulent flow within the emitted material, thereby allowing the selectively emitted material to be deposited in a desired and/or overall aesthetically pleasing manner.

It is a third object of the invention to provide a nozzle assembly which overcomes some or all of the previously delineated disadvantages of prior nozzle assemblies, which selectively emits material, and which includes a shroud member or portion which allows a second material to be emitted which is effective to cause the selectively emitted material to form and/or include substantially well-defined, relatively straight, and/or "clean" and/or "crisp" edges.

According to a first aspect of the present invention a member is provided for use with a nozzle of the type which selectively receives and which selectively emits material having a turbulent shear layer portion. The member is selectively coupled to the nozzle, is generally hollow, and selectively receives and emits a second material, effective to substantially eliminate the shear layer portion.

According to a second aspect of the present invention a nozzle assembly is provided. The nozzle assembly includes a first portion which selectively receives and which selectively emits material in a certain spray pattern, the certain spray pattern having at least one edge; and a second portion which selectively receives and which selectively emits a second material substantially along the at least one edge, effective to allow the emitted material to be deposited upon a certain location.

According to a third aspect of the present invention a method for use in combination with emitted material having a turbulent portion is provided. The method includes the steps of providing a second material; and causing the second material to form a laminar flow shroud which substantially surrounds the emitted material, thereby substantially eliminating the turbulent portion.

These an other features, aspects, and advantages of the present invention will become apparent from a reading of the following detailed description of the preferred embodiment of the invention, by reference to the following claims, and by reference to the attached drawings.

DETAILED DESCRIPTION OF THE PREFERRED EMBODIMENT OF THE INVENTION

Figure 1:
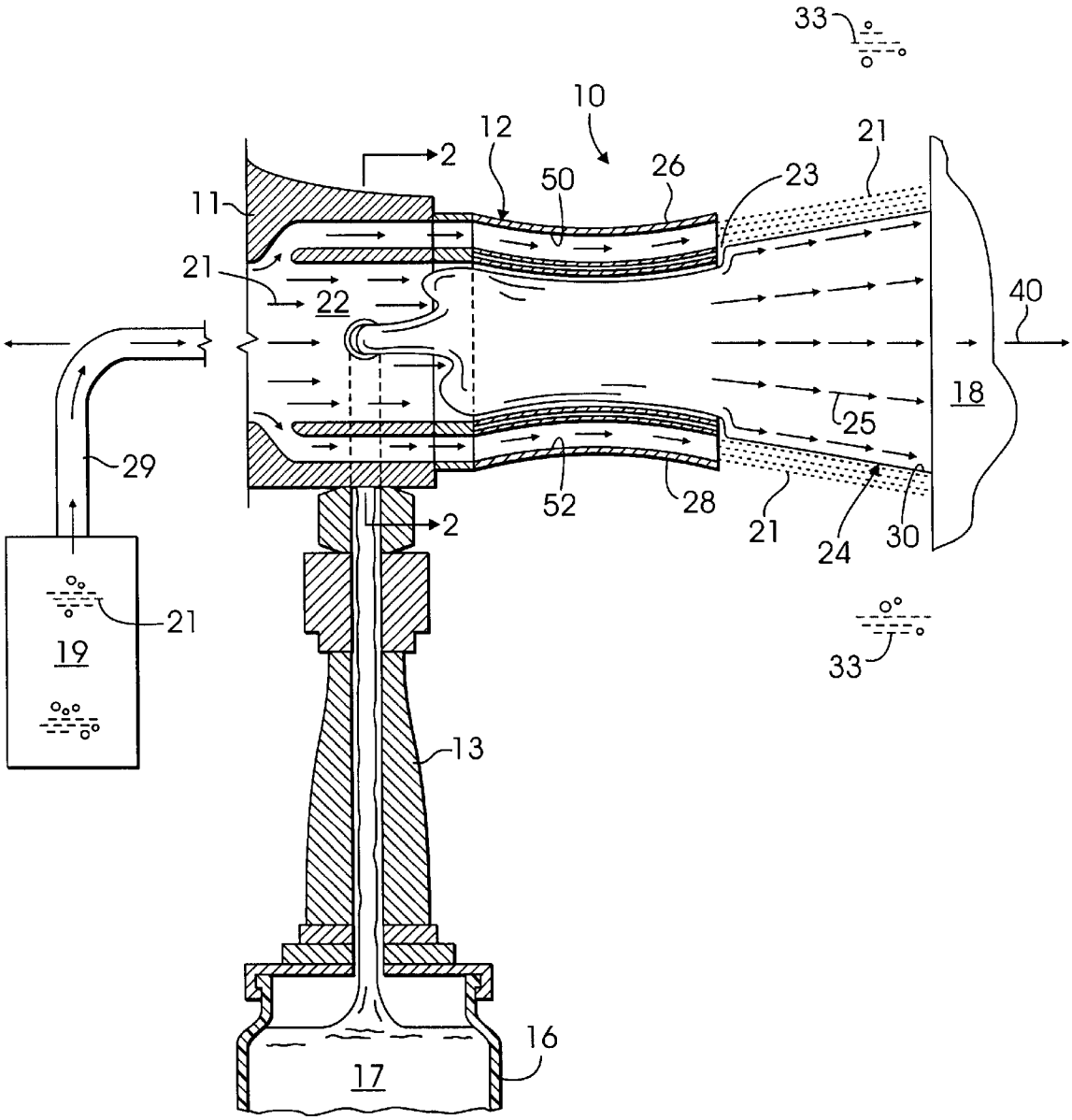
FIG. 1 is a side view of a material emitter which incorporates a nozzle assembly which is made in accordance with the teachings of the preferred embodiment of the invention.
Figure 2:
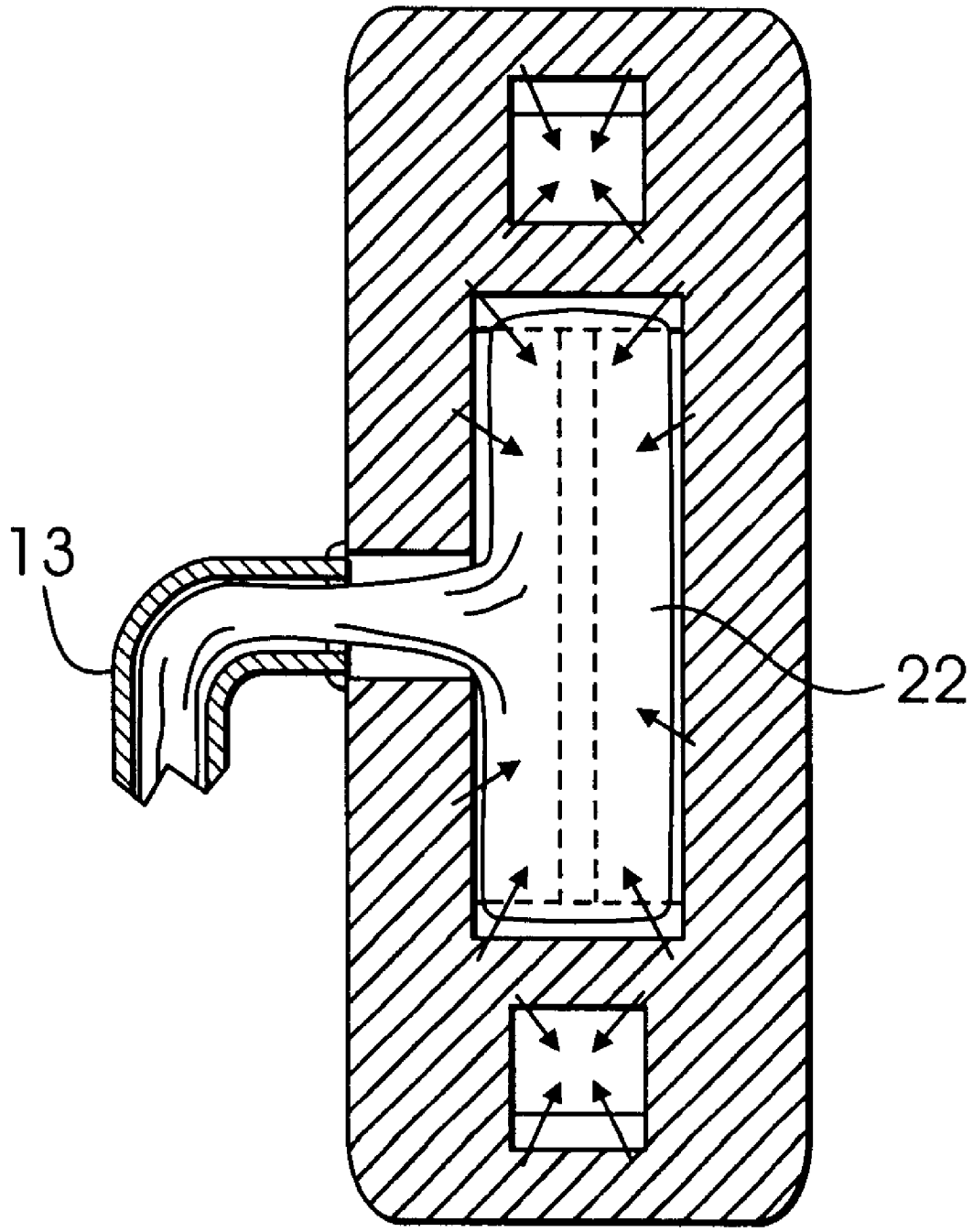
FIG. 2 is a sectional side view of the material emitter of FIG. 1 which is taken along view line 2—2.

Referring now to FIGS. 1–3 and 7, there is shown a material emitter 10 having a nozzle assembly 12 which is made in accordance with the teachings of the preferred embodiment of the invention. As shown, material emitter 10 includes a generally hollow material reception portion 11 which is physically and communicatively coupled, by conduit and/or hollow member 13, to a pressurized source 16 of material 17, such as paint or some other type of selectively emitted material. Portion 11 is further physically and communicatively coupled, by conduit and/or hollow member 29, to a pressurized source 19 of gas 21.

Particularly, the gas 21 and material 17 are communicated into the cavity 22 which is formed within portion 11 and are mixed within the cavity 22, effective to form material mixture 25 (e.g., in one non-limiting embodiment, the gas or material 21 selectively atomizes the material 17 and the atomized material 17 and the atomizing gas or material 21 enters the generally hollow nozzle portion 23 and is selectively emitted from the nozzle assembly 12). Particularly, the selectively created material mixture 25 is emitted, from aperture 61 which is formed within the material emission or nozzle portion 23 of the nozzle assembly 12, as a substantially conical shaped spray or spray pattern 24. More particularly, the material 17 which is included within the spray pattern 24 is selectively deposited upon a targeted location 18 which, in one non-limiting embodiment, may form a part or portion of a vehicle or automobile 20.

It should be appreciated that other types of spray patterns 24 (i.e., other shapes and/or sizes of spray patterns) may occur and/or be selectively formed by the material emitter 10, depending upon the type of nozzle assembly 12 which is utilized by the material emitter 10 and/or depending upon the type of gas 21 and/or material 17 which is utilized by the material emitter 10. It should additionally be realized that the principles of this invention are equally applicable to the use and/or selective formation of these other types of spray patterns and to a material emitter 10 which does not mix material 17 with material 21, but which selectively and alternatively utilizes and emits only material 17 within the created and/or formed spray pattern 24.

While a hand-held paint applicator or material emitter 10 is shown, it should also be appreciated that material emitter 10 may comprise virtually any other type of material applicator and that material 17 may comprise paint or virtually any other type of material which is desired to be selectively deposited upon a targeted location 18 and/or object 20. Further it should be appreciated that, in one non-limiting embodiment, portion 23 of the nozzle assembly 12 may be removably secured within portion 11. Alternatively, nozzle assembly 12 and/or nozzle portion 23 is integrally formed within portion 11.

In order to substantially increase the likelihood that the emitted material 25 is deposited only upon the targeted portion 18 and/or only upon the targeted object 20, that the emitted material 25 (i.e., in one non-limiting embodiment, the liquefied portion 17 of the mixed material 25) is deposited in an overall aesthetically pleasing manner, and that the deposited material portion 17 forms substantially "clean", "crisp", and "straight" edges, it is desirable to substantially reduce and/or eliminate the relatively turbulent shear type layer or turbulent portion which is formed around and/or which typically exists within and/or along the conical edge 30 of the spray pattern 24 and which occurs due to the undesired entrainment of ambient air or material 33 within the emitted material mixture 25.

In the preferred embodiment of the invention, a second material, as is more fully delineated below, is operatively used to substantially reduce and/or eliminate the turbulent shear layer and/or a portion of the turbulent shear layer within the spray pattern 24.

Figure 3:
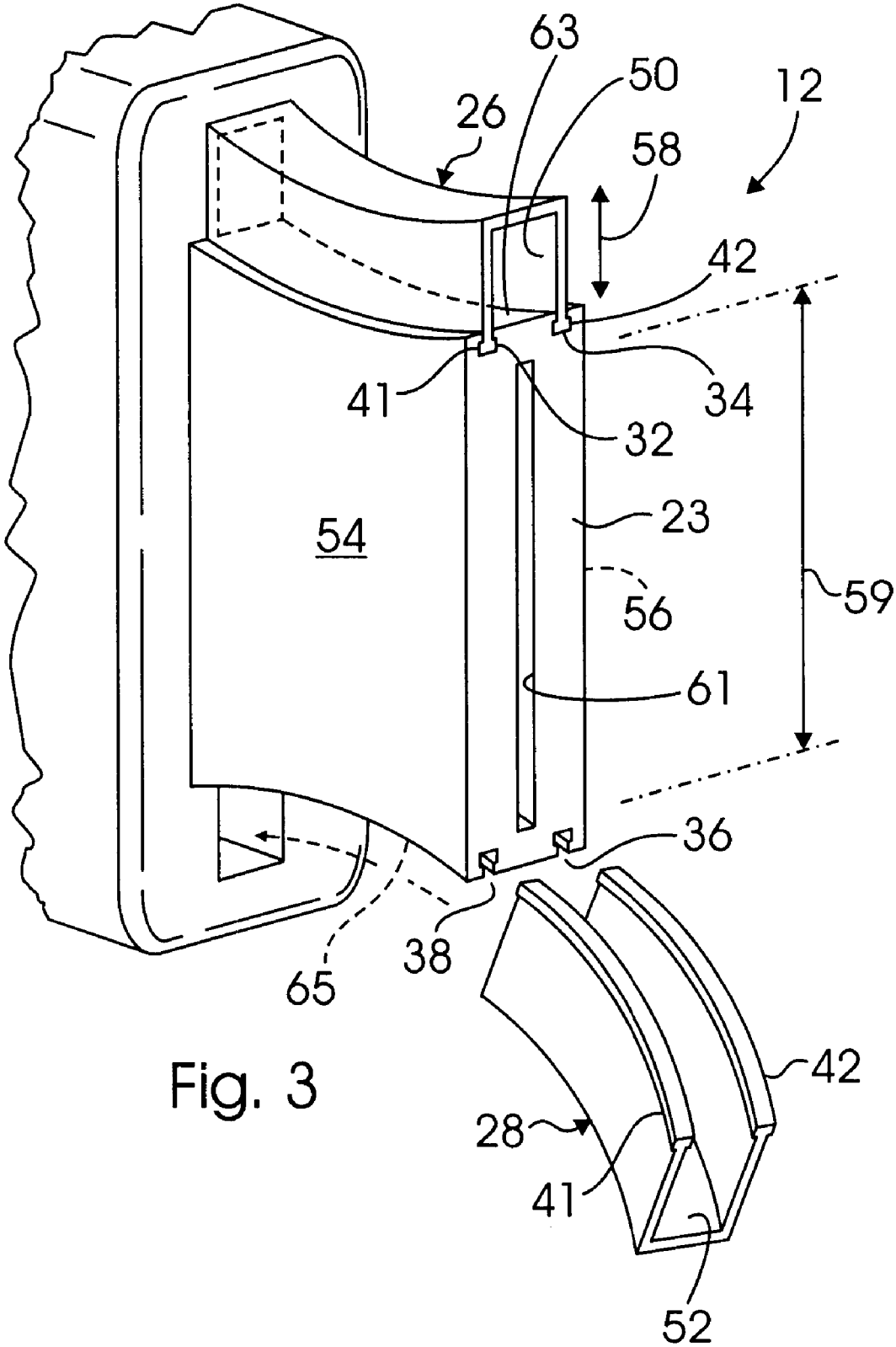
FIG. 3 is a fragmented perspective view of the material emitter which is shown in FIG. 1 and which further illustrates the selective placement of the shroud portion of the nozzle assembly upon and/or within the material emitter.

In one non-limiting embodiment of the invention, as best shown in FIGS. 1 and 3, a pair of substantially similar and generally "C"-shaped channel or "shroud forming" members 26, 28 are removably attached to the material emission portion 23 of the nozzle assembly 12. Particularly, as shown, in one non-limiting embodiment, the material emission portion 23 includes opposed pairs of channels, 32, 34; and 36, 38 which respectively reside upon the opposed top and the bottom surfaces 63, 65 of the portion 23. Each surface 63, 65 respectively and wholly resides in and/or forms a plane which is substantially parallel to the longitudinal axis of symmetry 40 of nozzle assembly 12. Each of the channels 32, 34, 36, and 38 are each of a substantially identical length and width.

As shown, each member 26, 28 has a pair of substantially identical flange or "feet" portions 41, 42 which generally conform to the shape of each of the channels 32–38 and which are each adapted to be frictionally and removably placed within a unique one of the channels 32–38. Hence, channels 32–38 cooperate with the flange members 41, 42 of each respective member 26, 28 to allow the "shroud forming" members 26, 28 to be removably secured to the nozzle portion 23 and to cooperate with the nozzle portion 23 to form "shroud generating" cavities and/or channels 50, 52. It should be appreciated that other members which are substantially similar to members 26, 28 may concomitantly or alternatively be placed upon surfaces 54, 56 of member or portion 23 and function in a substantially similar manner as members 26, 28. It should be further appreciated that in another non-limiting embodiment, only a single member 26 or 28 may be used.

As shown best in FIG. 1, each member 26, 28 is communicatively coupled to a pressurized source of a second material, such as and without limitation, gas 21, through material emitter 11. In another non-limiting embodiment, each channel 50, 52 may be coupled to a source of a second material by respective tubes or conduits (not own). Each member 26, 28 operatively and communicatively receives the second material within respective cavities 50, 52, thereby causing the second material, such as the pressurized gas 21, to be emitted along certain portions of the conically shaped edge 30, thereby substantially preventing the formation and/or eliminating the relatively turbulent shear layer at these certain edge portions by forming a laminar flow layer or "shroud" along and/or over these edge portions. By utilizing a member, such as one of the members 26, 28, upon each of the surfaces 54, 56, 63, 65, a laminar flow shroud may be selectively formed which substantially surrounds the entire emitted spray pattern 24. In one non-limiting embodiment, the velocity of the emitted material emanating from channels 50, 52 is substantially equal to the velocity of the emitted material mixture 25. Further, the height 58 of each of the channels 50, 52 is about one half of the height 59 of the outlet aperture 61 through which the material mixture 25 is selectively emitted.

Figure 4:
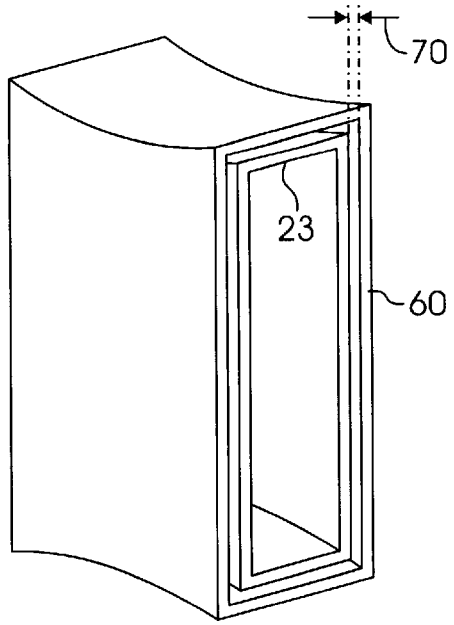
FIG. 4 is a fragmented perspective view of the material emitter which is shown in FIG. 1 and which further incorporates a nozzle assembly which is made in accordance with the teachings of an alternate embodiment of the invention.
Figure 5:
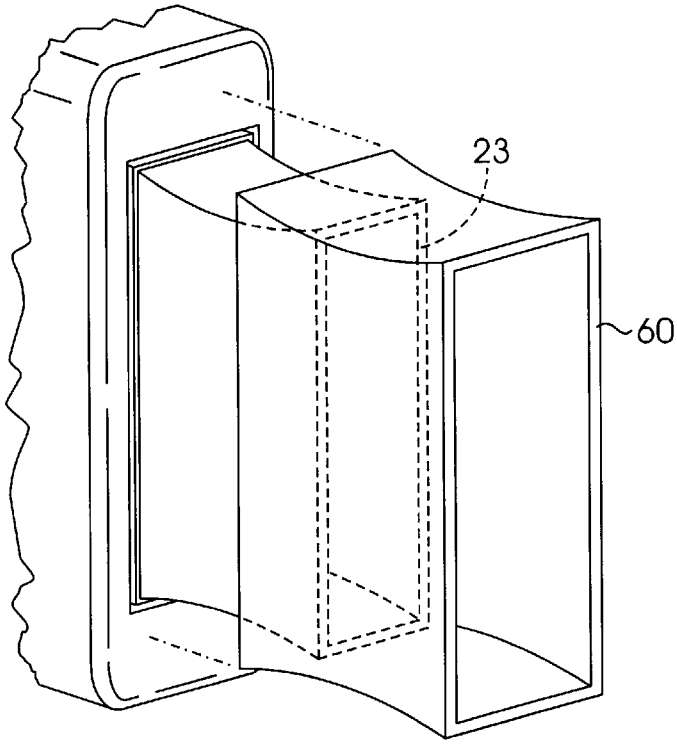
FIG. 5 is a fragmented perspective view of the material emitter which is shown in FIG. 4 and which further illustrates the selective placement of the shroud portion of the nozzle assembly upon and/or within the material emitter.
Figure 6:
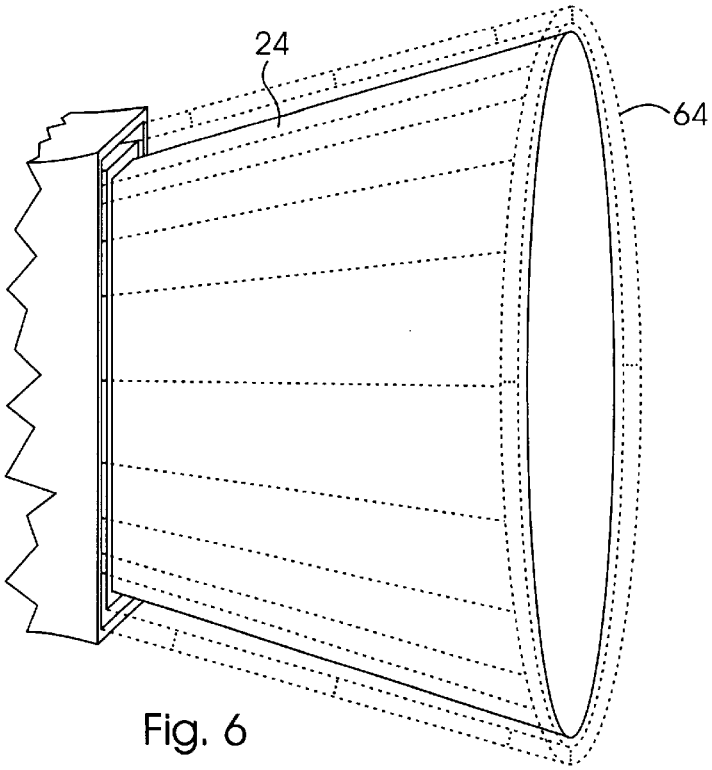
FIG. 6 is a perspective view of the emitted material and the selectively formed laminar shroud which is emitted by the nozzle assembly which is shown in FIGS. 4 and 5.
Figure 7:
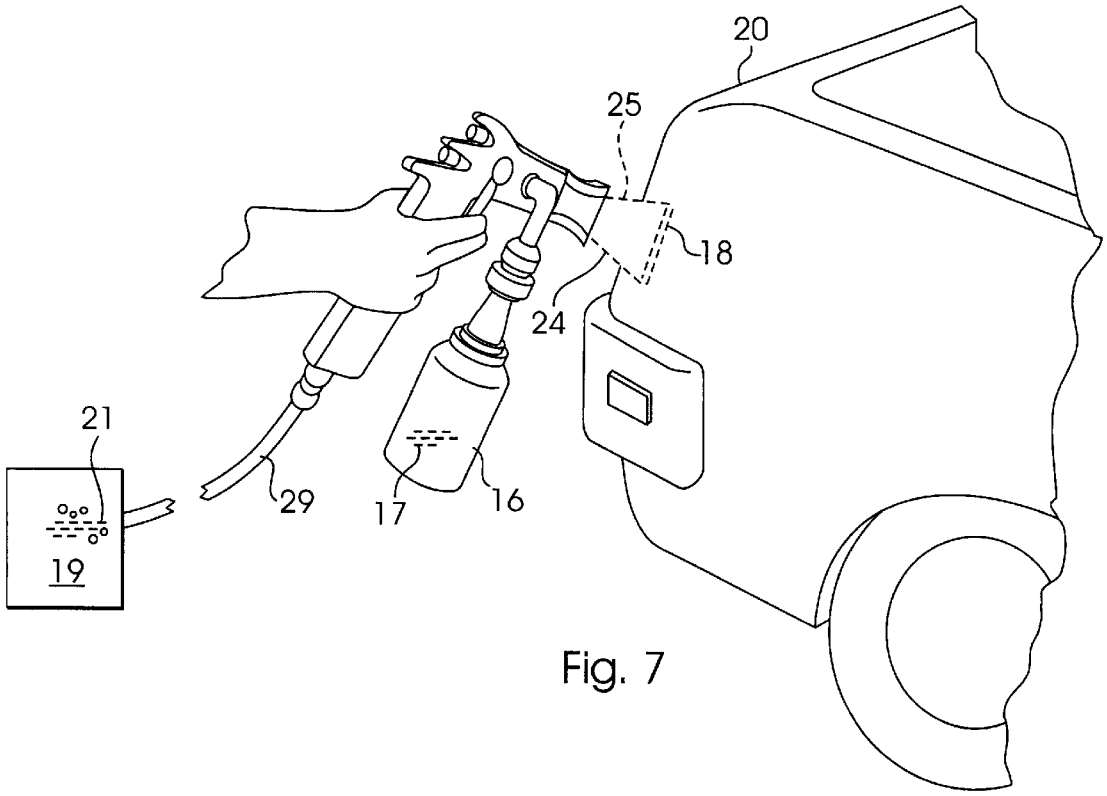
FIG. 7 is a perspective view of the material emitter which is shown in FIG. 1 and which illustrates the selective placement of paint upon certain targeted portions of a vehicle.

In another non-limiting embodiment of the invention, as best shown in FIGS. 4–5, to further reduce and/or to substantially reduce turbulence, a shroud member 60 replaces members 26, 28. Particularly, shroud member 60 is of substantially the same shape as is portion 23 but is slightly larger in size. In operation, member 60 is placed over member 23 (i.e., member 60 selectively, receivably, and operatively receives member 23) and a gap 70 is formed between member 60 and surfaces 54, 56, 63, and 65 of member 23. The second material, such as material 21, is communicatively coupled within and/or to this gap 70, and, as shown best in FIG. 6, forms a conical shaped spray pattern 64 which substantially surrounds substantially the entire emitted spray pattern 24 (i.e., the pattern 64 is formed along and/or around the entire conical edge 30), thereby substantially and further eliminating and/or reducing the turbulent shear layer at each portion of the conical spray surface.

It is to be understood that the invention is not limited to the exact construction or method which has been described and illustrated, but that various changes may be made without departing from the spirit and the scope of the invention.

What is claimed is:

1. A member for use in combination with a nozzle of the type which receives and emits a first material having a turbulent shear layer portion, said member being removably coupled to said nozzle and substantially coextensive with said nozzle, and which receives a second material and emits said second material, thereby substantially eliminating said turbulent shear layer wherein said member is substantially "C"-shaped and includes a first flange portion and a second flange portion which are removably attached to first and second channels in said nozzle.

2. The member of claim 1 wherein said first material comprises paint and wherein said second material comprises gas.

3. A nozzle assembly comprising a nozzle which receives and emits a first material in a certain spray pattern having at least one edge, and which includes a hollow reception portion which receives a second material, an inner cavity which is formed within said reception portion and which receives said first material and a portion of said received second material, effective to cause said first material to be emitted, and an outer cavity which is communicatively coupled to said reception portion, which is formed around said inner cavity and which receives said second material from said reception portion and emits said second material substantially along said at least one edge, effective to allow the emitted material to be deposited upon a certain location wherein said outer cavity is integrally formed as one piece with said reception portion.

4. The nozzle assembly of claim 3 wherein said material comprises paint and wherein said second material comprises gas.

5. The nozzle assembly of claim 4 wherein said certain location comprises a portion of a vehicle.

6. The nozzle assembly of claim 3 wherein said spray pattern is substantially conical.

7. The nozzle assembly of claim 3 wherein said second material substantially surrounds said emitted material.

8. The nozzle assembly of claim 3 wherein said outer cavity is substantially the same shape as said inner cavity.

9. A method for applying a material, the method comprising the steps of:

providing a first material;

providing a nozzle;

providing a second material;

receiving said second material in a first portion of said nozzle receiving said first material in a second portion of said nozzle; and causing said received second material to emit said first material and to form a laminar flow shroud which substantially surrounds the emitted first material.

10. The nozzle assembly of claim 4 wherein said outer cavity is substantially the same shape as said inner cavity.

11. The method of claim 9 wherein said emitted material is of a substantially conical shape.

12. The method of claim 11 wherein said laminar shroud is of a substantially conical shape.

13. The method of claim 10 wherein said paint is atomized.

* * * * *